US005393295A

United States Patent [19]

Knecht

[11] Patent Number: 5,393,295

[45] Date of Patent: Feb. 28, 1995

[54] SCORING APPARATUS

[75] Inventor: John Knecht, Chicago, Ill.

[73] Assignee: Stone Container Corporation, Chicago, Ill.

[21] Appl. No.: 22,684

[22] Filed: Mar. 1, 1993

[51] Int. Cl.[6] ..... B31B 1/25; B31F 1/10

[52] U.S. Cl. ..... 493/403; 493/396

[58] Field of Search ..... 493/396, 399, 400, 402, 493/403

[56] References Cited

U.S. PATENT DOCUMENTS

| | | | |
|---|---|---|---|
| 1,196,956 | 9/1916 | Kelleher | 493/402 |
| 1,362,330 | 12/1920 | Lange | 493/396 |
| 1,390,795 | 9/1921 | Lange | 493/396 |
| 1,935,522 | 11/1933 | Prior | 164/60 |
| 1,970,029 | 8/1934 | Brunner et al. | 493/402 |
| 2,421,457 | 6/1947 | Lindsay | 493/396 |
| 2,598,649 | 5/1949 | Rintoul | 164/70 |
| 3,074,324 | 1/1963 | Nobbe | 493/402 |
| 3,282,175 | 10/1963 | Moser et al. | 93/58.1 |
| 3,332,326 | 7/1967 | Haas | 93/58.2 |
| 3,526,566 | 9/1970 | McIlvain et al. | 493/396 |
| 3,709,111 | 1/1973 | Grobman | 93/58.2 |
| 3,744,384 | 7/1973 | Jarritt et al. | 493/403 |
| 4,141,544 | 2/1979 | Birkenmayer | 493/403 |
| 4,936,818 | 1/1990 | Holohan | 493/403 |

FOREIGN PATENT DOCUMENTS 92908 7/1896 Germany .

*Primary Examiner*—William E. Terrell
*Attorney, Agent, or Firm*—Dick and Harris

[57] ABSTRACT

A scoring apparatus for use in imparting scores in paper products to reduce the occurrence of random yielding upon folding. The scoring apparatus includes a scoring member and a paper products platform member and is operably associated with a power source for forcing at least the scoring member, and the paper products into contact with one another. The scoring member includes a scoring profile having a scoring bead member for imparting scores in paper products and an integrated shoulder for partially crushing and weakening a portion of the paper products on one side of the resulting score line. The scoring apparatus creates a desired score line with a substantially weakened portion on one side of the score line, with a substantially unweakened portion on the other side of the score line—to substantially reduce the random yielding of the paper products during the folding of those paper products along the score line.

13 Claims, 1 Drawing Sheet

SCORING APPARATUS

BACKGROUND OF THE INVENTION

The present invention relates in general to the manufacture of containers formed from paper products and, in particular, to a scoring apparatus for use in imparting scores to paper products such that they can be folded into useful products, such as corrugated containers. Scoring is the process of placing an indentation in a sheet of paper products to facilitate later folding along the resulting score line.

Most often paper products are formed into articles, such as containers, from continuous sheets of paper products. These continuous sheets of paper products are most often manipulated by automated machines in a continuous in-line process involving cutting, scoring and folding of the continuous sheets of paper products into multiple independent blanks of a desired configuration.

One paper product that is often used in the manufacture of paper products containers is liner board bonded corrugated medium. Liner board bonded corrugated medium typically consists of an inner liner board layer, an outer liner board layer and fluted, corrugated medium material adhesively sandwiched therebetween. In manufacturing paper products such as articles fabricated of such liner board bonded corrugated medium, there may be random variations in the position of the crest and groove pattern of the fluted corrugated medium, relative to the location of the score. While such random variations are acceptable in the construction of such paper product and even in paper product containers, such randomness has heretofore often interfered with the folding process, affecting the orientation of folded parts, and particularly paper product panel locations, after articulation into a container, for example.

Current scoring apparatuses utilize scoring profiles typically having a scoring bead and two integrated scoring shoulders, one on each side of the scoring bead. While only the scoring bead is necessary for directly imparting the score, each of the integrated shoulders typically comes into contact with the paper products, crushing a portion of the paper products on each side of the resulting score line. After such a scoring operation, the crushed regions formed by the shoulders are generally not readily visible because the elasticity of the paper products often results in near, visual restoration of the structure. However, the crushing of the paper material on each side of the score line nonetheless affects the folding of the article to, in turn, affect the orientation of adjacent product panels.

Paper product sheets that are scored directly upon a crest of the flutes generally fold as intended. However, paper products sheets that are scored by current scoring apparatuses with a score line parallel to, but distally spaced from a corrugated crest tend to fold randomly, because a portion of the paper product to each side of the score line is often affected by the integrated shoulders crushing each. Thus, upon folding, a panel on one side of a fold may be longer than the panel on the other side of the fold resulting in "manufacturer's gap variation," as explained more fully herein. Furthermore, folding may not be consistent throughout a single score line, resulting in "skewing," as explained more fully herein.

Paper product containers are usually shipped folded flat prior to articulation, in bundles from the container manufacturer to the customer. However due to this manufacturer's gap variation and skewing, the flattening and bundling of the flat paper products containers for shipping often becomes uneven and unpredictably orientated due to the random folding problems.

It is thus an object of the present invention to prevent and/or reduce skewing and to orchestrate acceptable manufacturer's gap variation by providing a scoring apparatus which reduces the occurrence of random yielding of scored paper products during folding.

These and other objects of the present invention will become apparent in light of the present specification, claims and drawings.

SUMMARY OF THE INVENTION

The present invention comprises a scoring apparatus of the type operably maintained by a supporting structure for use in imparting scores in paper products—to reduce the occurrence of random yielding of these paper products during folding.

The scoring apparatus includes a scoring means and a paper products platform means, which may include a top layer of urethane elastomeric, for removably maintaining the paper products in operable position between the scoring means and the paper products platform means such that the scoring means can operably impress and impart scores in the paper products. Each of the scoring means and the paper product platform means can be either a wheel or a platen member. Where the scoring means and the paper product platform means comprise a wheel, these wheels may be supported by a rotatable shaft located at the center of the wheel. This rotatable shaft in the scoring means may further comprise scoring means connecting means connecting the scoring means to supporting structures.

In the preferred embodiment of the invention, the scoring means includes a scoring profile and a scoring profile support means for operably supporting the scoring profile. The scoring profile support means is operably connected to the supporting structure by the scoring means connection means. In one embodiment, the scoring profile support means can further include reinforcement shoulders displaced radially inwardly from the scoring profile to further provide structural support and integrity to the scoring profile.

Also in the preferred embodiment, the scoring profile means includes a scoring bead for imparting scores in the paper products to, in turn, create a score line along which the paper products can be folded in a facilitated manner. The scoring profile means further includes integrated shoulder means transversely projecting from one side of the scoring bead. The other side of the scoring bead is substantially devoid of any such shoulder. In the preferred embodiment, the scoring profile means scores the paper products, creating a score line and partially crushes a portion of the paper products to one side of the score line; leaving substantially uncrushed the portion of the paper products to the other side of the score line, thus, weakening a portion of the paper products on only the one side of the score line, while substantially maintaining the structural integrity of the portion of the paper product immediately adjacent the other side of the score line so as to reduce the random yielding of the paper products during folding along the score line.

The present scoring apparatus is operably associated with power means which forces at least one of the scoring means, paper products platform means and paper products into contact with one another, respectively, to impart the score line into the paper products. For instance, in one potential embodiment, the power means drives a rotatable shaft connected to the scoring means or, alternatively may be connected to the paper products platform means for pulling the paper products through the apparatus. This embodiment may further include the ability to operably and horizontally displace the scoring means over a stationary paper product. In another preferred embodiment, the paper products move through the scoring apparatus due to the force of another apparatus, such as one positioned in-line with the scoring apparatus, that is either accepting and moving paper products from the scoring apparatus or moving and projecting the paper products into the scoring apparatus.

In the embodiment having a scoring means comprising a wheel, the scoring profile support means comprises a wheel and the scoring means connection means comprises a rotatable shaft. In this embodiment, the scoring profile is further positioned radially about the periphery of wheel—creating a scoring wheel member.

In the embodiment having a scoring means comprising a platen member, the scoring profile support means is substantially flat on its operable side such that the scoring profile still includes a projecting scoring bead and integrated projecting shoulder means on one side of the projecting scoring bead, while being substantially devoid of an integrated shoulder on the other side of the projecting scoring bead.

In another embodiment, the apparatus further includes a cooperating second scoring means for operably imparting scores in the paper products. This second scoring means includes a second scoring profile and a second scoring profile support means for operably supporting the second scoring profile. The second scoring profile means includes a second scoring bead which creates a second score line in the paper products, parallel to and distally spaced from the score line created by the first scoring means. Thus, the second scoring profile has a similar, but mirror-image orientation as the first scoring profile. The bead and integrated shoulder of the first scoring means is positioned opposite to the bead and integrated shoulder of the second scoring means.

In this preferred embodiment, the second scoring profile further includes integrated shoulder means transversely projecting from the other side of the second scoring bead, opposite the one side of the second scoring bead, for partially crushing a second portion of the paper products—on the other side of the second score line to, in turn, weaken a second portion of the paper products. The one side of the second scoring bead is substantially devoid of any such shoulder. Thus, the first and second scoring profile means both score the paper products, simultaneously creating first and second score lines parallel, but distally spaced from one another, while partially crushing portions of the paper products on the opposite outside regions adjacent the two score lines—leaving the region between the paired score lines substantially uncrushed; so as to reduce the random yielding during folding at each score line resulting in a reduction of skewing and potential orchestration of manufacturer's gap variation in the creation of paper product containers.

In this preferred embodiment distinct paper products platform means are associated with each of the scoring means, though a single, integrated paper products platform means may be utilized comprising a wheel or a substantially flat platen member.

DETAILED DESCRIPTION OF THE DRAWINGS

Figures 1, 2, 3, 4A, 4B, 5A, 5B, 6, 7, 8, 9:
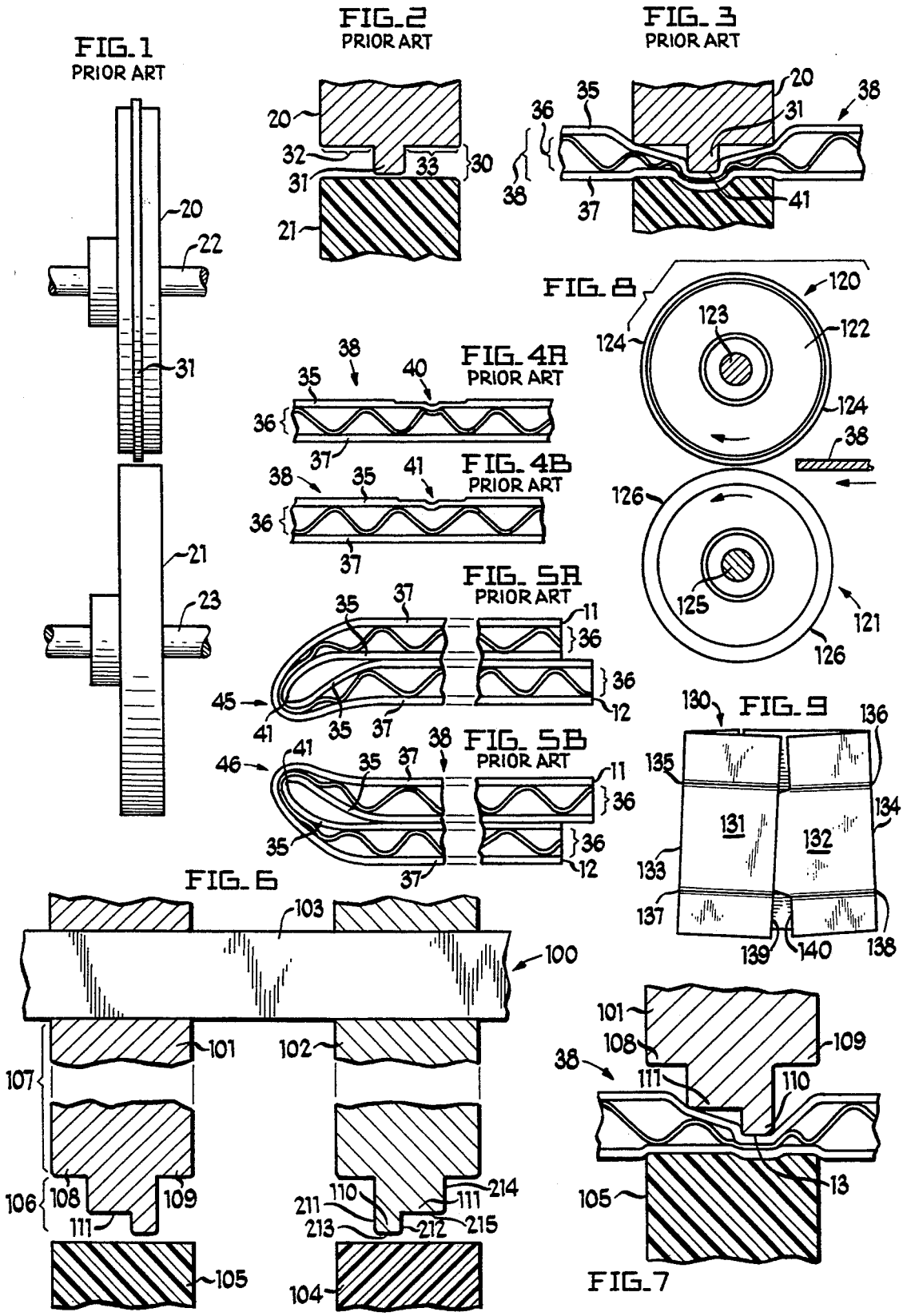
FIG. 1 PRIOR ART
FIG. 2 PRIOR ART
FIG. 3 PRIOR ART
FIG. 4A PRIOR ART
FIG. 4B PRIOR ART
FIG. 5A PRIOR ART
FIG. 5B PRIOR ART
FIG. 1 of the drawings is a front elevational view of a prior art scoring apparatus showing, in particular, a rotatable scoring wheel member and a rotatable platform wheel member operably located below the rotatable scoring wheel member.
FIG. 2 of the drawings is an enlarged, cross sectional, front elevational view of the scoring profile of prior art scoring wheel members, also showing the mated portion of a prior art platform wheel member.
FIG. 3 of the drawings is an enlarged, cross sectional, front elevational view, of the prior art scoring profile and platform members in operable engagement with a corrugated paper product showing, in particular, the orientation and operable crushing of the article by two integrated shoulder members, one being located on each side of the scoring bead member.
FIGS. 4A and 4B are fragmentary end views of a corrugated paper product having already been scored by the conventional scoring assemblies of FIGS. 1 through 3 showing, in particular, two various score orientations where the score is imparted either directly upon or merely parallel to a flute crest in the corrugated paper product, which can occur in random fashion, respectively.
FIGS. 5A and 5B of the drawings are fragmentary end views of folded corrugated paper products showing articles scored by prior art scoring apparatuses; yielding randomly upon folding and resulting in the portion of the corrugated paper products on one side of the fold being longer than the portion of paper products on the other side of the fold.
FIG. 6 of the drawings is a fragmentary, cross sectional, front elevational view of an embodiment of Applicant's present scoring apparatus in the tandem embodiment of two scoring members, with corresponding scoring member connection member and two respectively aligned paper product platform members.
FIG. 7 of the drawings is a fragmentary front, cross sectional, elevational view of the present invention showing, in particular, Applicant's present scoring apparatus with a corrugated paper product being scored therewithin.
FIG. 8 of the drawings is a side elevational view of one embodiment of Applicant's present scoring apparatus showing, in particular, the scoring member, the corrugated paper product and the paper products platform member.
FIG. 9 of the drawings is a top plan view of a paper products container produced by prior art scoring apparatuses showing, in particular, skewing at the folds of said paper products container resulting in manufacturer's gap variation.

While this invention is susceptible of embodiment in many different forms, they are shown in the drawings and will herein be described in detail, several specific embodiments with the understanding that the present disclosure is to be considered as an exemplification of the principles of the invention and is not intended to limit the invention to the embodiments illustrated.

Portions of prior art scoring apparatuses are shown in FIGS. 1 through 3 including rotatable scoring wheel member 20, rotatable platform wheel member 21, respective rotatable shafts 22 and 23 and scoring profile 30. In FIG. 2, scoring profile 30, which is shown in section, is attached to and positioned radially about the entire periphery of rotatable scoring wheel member 20. Scoring profile 30 includes scoring bead member 31, first integrated shoulder member 32 transversely projecting from one side of scoring bead member 31 and second integrated shoulder member 33 transversely projecting from the other side of scoring bead member 31, opposite said one side of scoring bead member 31.

FIG. 3 of the drawings shows the prior art apparatus of FIGS. 1 and 2, in operation, scoring corrugated paper product 38. Corrugated paper product 38 is comprised of an inner liner 35 and outer liner 37, both of which are usually constructed of liner board, and flute 36, a corrugated material that is adhesively sandwiched between inner liner 35 and outer liner 37. Corrugated paper product 38 is removably maintained in position for scoring by rotatable platform wheel member 21, such that scoring bead member 31 can impart a score into corrugated paper product 38. As scoring bead member 31 forms an indentation in inner liner 35 of corrugated paper product 38 it incidentally partially crushes the proximate structure of corrugated paper product 38 on each side of the score line, including the portion of flute 36 adjacent outer liner 37, proximate to indentation score 41 in inner liner 35. First integrated shoulder 32 and second integrated shoulder 33 simultaneously engage corrugated paper product 38, partially crushing same on each side of score 41.

FIGS. 4A and 4B are fragmentary end views of corrugated paper product 38 after having been scored by scoring profile 30, and integrated shoulders 32 and 33. As shown in FIGS. 4A and 4B, after scoring of corrugated paper product 38, the elasticity of corrugated paper product 38 results in the near visual restoration of the regions proximate the score line 41, substantially to their original position, with only a score line 40 or 41 visually apparent. Although the scoring bead member does not move laterally, due to random variations occurring in the manufacture of corrugated paper product 38, the location of the score line relative to flute 36 can often be random. As shown in FIG. 4B, score line 41 is parallel to a crest of flute 36. As shown in FIG. 4A, score line 40 occurs directly upon a flute crest of flute 36, in corrugated paper product 38.

FIGS. 5A and 5B of the drawings are fragmentary end views of corrugated paper product 38 after having been scored in FIG. 4B and folded along score line 41. Folding corrugated paper product 38 which has been scored directly upon a crest of flute 36, such as score line 40, shown in FIG. 4A results in one folding pattern. However where corrugated paper product 38 is scored parallel to the crests of flute 36, score line 41 shown in FIG. 4B, folding can result in an undesirable "manufacturer's gap variation" and potentially in "skewing." After scoring, the elasticity of the corrugated medium proximate the score line causes only near visual restoration of the paper product sheet to its original orientation with some indentation of inner liner 35 as scored in FIG. 3.

Upon folding, the paper product sheet generally yields at the scored location until the fold itself reaches an angle of about 120 degrees. When the fold angle reaches approximately 120 degrees, outer liner 37 becomes taut, in tension, and inner liner 35 is compressed until it presses against flute 36 and outer liner 37. As corrugated paper product 38 is further compressed, such further folding will result in structural reorientation causing inner liner 35 to buckle and those portions of flute 36 exposed to crushing against shoulders 32 and 33 will yield. Since both sides of flute 36 adjacent score line 41 have been crushed by first integrated shoulder member 32, transversely projecting from one side of scoring bead member 31, and second integrated shoulder member 33 transversely projecting from the other side of scoring bead member 31, the yielding of the previously crushed flutes, upon such folding is random, with either side distorting to accommodate the fold.

For instance, corrugated paper product 38 generally yields at score line 41 during folding until the fold reaches this critical fold angle of about 120 degrees, at which time further deformation, on one or the other side of the score line occurs. The randomness of the deformation is further shown in FIGS. 5A and 5B where folds 45 and 46 cause corrugated paper product end 11 to be inwardly displaced relative to corrugated paper product end 12 on some occasions, and to be outwardly displaced relative to corrugated paper product end 12 on other occasions—without control. The net aggregation of such uncontrolled manufacturer's gap variation can result in the undesirable misalignment of an articulated product made from the paper product. Furthermore, such random yielding may also be found within a score line. For example, at the lead edge of score line 41, corrugated paper product 38 may fold as shown in FIG. 5A with corrugated paper product end 11 inwardly displaced relative to corrugated paper product end 12, but as the fold continues along score line 41 the paper product may fold as shown in FIG. 5B with corrugated paper product end 11 outwardly displaced relative to corrugated paper product end 12—crossing through a point at which corrugated paper product end 11 and corrugated paper product end 12 are even, as shown in FIG. 9, as discussed hereinbelow.

FIG. 6 of the drawings is a fragmentary, cross sectional, front elevational view of the tandem embodiment of Applicant's present scoring apparatus 100 showing first scoring means 101, second scoring means 102, scoring means connection means 103, first paper product platform means 105 and second paper products platform means 104. Although there is shown in FIG. 6 two scoring means as part of apparatus 100, it should be understood by one of ordinary skill in the art that Applicant's invention 100 can be practiced with only a single scoring means corresponding to the present invention. The structure and function of first scoring means 101 and first paper products platform means 105 is identical to the structure and function of second scoring means 102 and second paper product platform means 104. The orientation of second scoring means 102 differs from that of first scoring means 101, with second scoring means 102 being rotated 180 degrees about its y-axis from the orientation of first scoring means 101. Inasmuch as the two illustrated scoring means are identical, but for their mirror-image orientation, only the structure and function of first scoring means 101, as shown in FIGS. 6 and 7, shall be described in detail with the understanding that the structure discussed applies equally to second scoring means 102. FIGS. 6 and 7, in cross section, likewise show the operating characteristics of Applicant's wheel and platen embodiments.

First scoring means 101 operably imparts scores to corrugated paper product 38. First scoring means 101 includes scoring profile 106 and scoring profile support means 107, which is in turn operably connected to scoring means connection means 103. Scoring profile support means 107 may further include first reinforcement shoulder 108 and/or second reinforcement shoulder 109; to further provide structural support and integrity to scoring profile 106.

Scoring profile means 106 includes scoring bead 110 and integrated shoulder means 111. Scoring bead 110 scores corrugated paper product 38, creating a score line, such as score line 13 (shown in FIG. 7), in corrugated paper product 38. Integrated shoulder means 111 transversely projects from only one side of scoring bead 110. Integrated shoulder means 111 is displaced radially inwardly from scoring bead 110, such that only integrated shoulder means 111, and no other integrated shoulder on the opposite side of scoring bead 110, partially crushes a portion of corrugated paper product 38 to the one side of score line 13 created by scoring bead 110. As shown in FIG. 7, scoring bead 110 substantially indents corrugated paper product 38, while integrated shoulder means 111 partially crushes a portion of corrugated paper product 38 to one side of score line 13, which is created by scoring bead 110.

In a preferred embodiment of the invention, as illustrated in FIG. 6, scoring bead 110 has first side 211 and second side 212 from which integrated shoulder means 111 transversely projects. First side 211 extends from scoring profile support means 107, while second side 212 extends from integrated shoulder means 111. Scoring bead 110 further includes outer tool surface 213 extending between first side 211 and second side 212, which sides and surface cooperate to operably impart scores in paper products 38 to, in turn, create score lines. Integrated shoulder means 111 includes shoulder side 214 extending from scoring profile support means 107 and outer shoulder surface 215 extending between scoring bead second side 212 and shoulder side 214.

Paper products platform means 105 removably maintains corrugated paper product 38 in operable position beneath scoring bead 110 and integrated shoulder means 111 to engage corrugated paper product 38—to enable scoring and partially crushing corrugated paper product 38 along the score line and to one side of the score line, respectively. Following the scoring operation, the elasticity of corrugated paper product 38 results in the near visual restoration of corrugated paper product 38 substantially to the original orientation with only score line 13 visibly showing.

The location of score line 13 relative to the crests of flute 36 will still be random after processing by apparatus 100, due to inherent variations occurring in the manufacture of corrugated paper product 38 relative to the ultimate location of the score relative to the flute crests. However, unlike prior art scoring apparatuses, only a portion of corrugated paper product 38 to one side of score line 13 has been crushed during the scoring operation due to the engagement of integrated shoulder means 111 upon that portion of corrugated paper product 38. Because only a portion of one side of corrugated paper product 38 was crushed, yielding during folding will be less random than in prior art apparatuses wherein both sides of corrugated paper product 38 were crushed. Thus, depending upon which one side of scoring bead 110, the integrated shoulder means was located, corrugated paper product 38 will tend to yield easier on that one side of score line 13 and not on both sides.

Upon folding, corrugated paper product 38 generally yields at score line 13 until the fold reaches an angle of about 120 degrees. At this critical angle, outer liner 37 is taut, in tension, and inner liner 35 is tucked down, pressing against flute 36 and outer liner 37. As in the prior art, further folding compresses corrugated paper product 38 resulting in structural collapse—at which point inner liner 37 will buckle and flute 36 will yield. However, unlike the prior art, only the portion of flute 36 to the one side of score line 13, has been weakened by integrated shoulder means 111 transversely projecting from only one side of scoring bead 110—leaving the portion of flute 36 on the other side of score line 13 substantially unweakened. Therefore, as the fold reaches its critical angle of approximately 120 degrees, it is more likely that the previously substantially crushed portion of flute 36 to the one side of score line 13, will yield before the substantially unweakened portion will yield. Thus, by positioning integrated shoulder means 111, the relative displacement of corrugated paper product ends to each other can be substantially controlled.

FIG. 8 of the drawings is a side elevational view of one potential embodiment of scoring apparatus 100, wherein scoring means comprises scoring wheel member 120 and paper products platform means comprises platform wheel member 121. Scoring wheel member 120 includes circular scoring profile support means 122, rotatable shaft connecting means 123 and radial scoring profile 124, which circles the entire periphery of circular scoring profile support means 122. Platform wheel member 121 is supported by rotatable shaft 125 and may be covered with urethane elastomeric 126, about the entire periphery of platform wheel member 121, to accept the impression of scoring wheel 120 into corrugated paper product 38. In this embodiment, corrugated paper product 38 moves from right to left, scoring wheel member 120 rotates clockwise and platform wheel member 121 rotates counter-clockwise. The movement of corrugated paper product 38, scoring wheel member 120 and platform wheel member 121 is operably associated with power means operably connected therebetween (not shown).

In one potential embodiment, scoring apparatus 100 can be part of an in-line manufacturing process, wherein there exists at least one associated apparatus which, incidental to the further fabrication of corrugated paper product 38, introduces corrugated paper product 38 into, through and out of scoring apparatus 100. Thus, an associated apparatus may act as the power means for scoring apparatus 100.

In another potential embodiment, scoring apparatus 100 can be a hand-held unit, which a mechanical device or a human operator moves over corrugated paper product 38, while it is maintained in position by platen style paper products platform means. As the mechanical device or human operator moves scoring apparatus 100, the scoring means which may be a scoring wheel member, may incidentally rotate about a shaft.

In the embodiment where the scoring means comprises a platen member a human operator or mechanical device may utilize a press-type approach wherein the operator operably places the scoring means of the paper product and applies downward pressure to the scoring means such that a score is imparted in the paper product. In this embodiment, the scoring means is elongated along the axis of travel, such that the scoring means can stamp a portion of a score line into corrugated paper product 38. The scoring means is horizontally displaced over the corrugated paper product 38 and then lowered into operable position such that the next pressing operation results in a continuation of the previously imparted score, thus resulting in a score line.

In another potential embodiment, the platen member scoring means comprises a scoring bead member which is displaced in a plow-like manner to score the paper product, without tearing the inner liner of the corrugated paper product 38.

FIG. 9 of the drawings is a plan view of paper product box 130 formed from corrugated paper product 38 produced by a prior art scoring apparatus. Unlike FIGS. 5A and 5B of the drawings, in which corrugated paper product end 11 and corrugated paper product end 12 are displaced inwardly or outwardly relative to each other, FIG. 9, and particularly folds 133 and 134, show the effect of such randomness within a single edge, to create what is often characterized as "skewing." For instance, where FIG. 5B is considered a partial cross sectional, end view of leading edge 135 of fold 133 and FIG. 5A is considered a partial, cross sectional, end view of trailing edge 137 of fold 133, skewing is exhibited. Between leading edge 135 and trailing edge 137, fold 133 is "skewed," or rotated, such that this single edge moves from the position of corrugated paper product end 11 displaced outwardly relative to corrugated paper product end 12, to corrugated paper product ends 11 and 12 being even, and finally through to corrugated paper product end 11 being displaced inwardly relative to corrugated paper product end 12. In FIG. 9, the skewing of prior art folds 133 and 134 have opposed one another—with one fold skewing in one direction and the other in an opposite direction. Thus, panel 131 and panel 132, become oriented in opposition, creating a wide and undesirable gap.

In one potential embodiment of scoring apparatus 100, shown in FIG. 6 of the drawings, integrated shoulder means 111 of scoring means 101 and scoring means 102 both transversely project outwardly, as mirror images of one another. Scoring means 101 and 102 are used to impart score lines, while partially crushing adjacent regions of the same sheet of paper products. The paired scoring means have mirror-image shoulder means that transversely project outwardly, such that the substantially crushed portions of the sheet of paper products are to the outside of each of the two, parallel and distally spaced imparted score lines. This orientation facilitates yielding of the folded paper product in such a manner that not only is skewing substantially prevented, but manufacturer's gap variation is substantially controlled and reduced to facilitate assembly of a paper product container. This mirror-image orientation of the integrated shoulders is intended to result in opposing panels of the resulting paper product container being of substantially the same length. If the integrated shoulders were orientated on the same side of their respective scoring bead members, this could result in opposing panels in the resulting paper products container having opposing manufacturing gaps, and thus the opposing panels could be of differing lengths resulting in a lopsided container.

The foregoing description and drawings merely explain and illustrate the invention and the invention is not limited thereto, except insofar as the appended claims are so limited and as those skilled in the art who have the disclosure before them will be able to make modifications and variations therein without departing from the scope of the invention.

What is claimed is:

1. A scoring apparatus of the type operably maintained by a supporting structure for use in imparting scores in paper products, such as liner board bonded corrugated medium, to reduce the occurrence of random yielding of said paper products upon folding of same, said scoring apparatus comprising:

scoring means for operably imparting scores in said paper products, said scoring means having a scoring profile and a scoring profile support means for operably supporting said scoring profile;

said scoring profile means including a scoring bead having a first side and a second side opposite said first side, for imparting scores in said paper products to, in turn, create a score line along which said paper product can be folded in a facilitated manner, and integrated shoulder means transversely projecting from said second side of said scoring bead for partially crushing a portion of said paper products on said one side of said score line to, in turn, weaken said portion of said paper products;

said scoring profile means being substantially devoid of a second integrated shoulder means on the first side of said scoring bead, opposite said second side of said scoring bead, leaving substantially uncrushed the portion of said paper products on said first side of said score line;

said first Side extending from said scoring profile support means and said second side extending from said integrated shoulder means, said scoring bead further including an outer tool surface extending between said first and second sides, said outer tool surface co-operating with said first and second sides to operably impart said scores in said paper products to, in turn, create said score line;

said integrated shoulder means having a shoulder side extending from said scoring profile support means, and an outer shoulder surface extending between said second side of said scoring bead and said shoulder side:

scoring means connection means for operably connecting said scoring profile support means to said supporting structure for operably supporting said scoring means;

paper products platform means for removably maintaining said paper products in an operable position between said scoring means and said paper products platform means to facilitate the imparting of said scores in said paper products by said scoring means; and power means operably associated with said scoring apparatus for forcing at least said scoring means and said paper products into contact with one another, respectively, to impart said score line into said paper products;

said scoring bead and said integrated shoulder on said one side of said scoring bead imparting said score line to said paper products while substantially weakening said portion of said paper products on said one side of said score line, while substantially maintaining the structural integrity of said paper products on said other side of said score line so as to reduce the random yielding of said paper products sheet, during the folding of said paper products along said score line.

2. The invention according to claim 1 wherein scoring profile support means comprises a wheel;

said scoring means connecting means comprising a rotatable shaft located at the center of said wheel.

3. The invention according to claim 2 wherein said scoring profile is positioned radially about the periphery of said scoring profile support means to collectively create a scoring wheel member.

4. The invention according to claim 3 wherein said power means is operably connected to said rotatable shaft for rotating said scoring wheel member.

5. The invention according to claim 4 wherein said scoring means is operably and horizontally displaceable by said power means.

6. The invention according to claim 1 wherein said paper products platform means comprises a platform wheel member supported by a rotatable shaft located at the center of said platform wheel member.

7. The invention according to claim 6 wherein the outer peripheral rim of said platform wheel member comprises a layer of urethane elastomeric.

8. The invention according to claim 1 wherein said scoring profile support means includes reinforcement shoulders displaced radially inwardly from said scoring profile, to further impart structural support and integrity to said scoring profile.

9. The invention according to claim 1 wherein said scoring means is operably and horizontally displaceable by said power means.

10. The invention according to claim 1 wherein the apparatus further includes:

second scoring means for operably imparting scores in said paper products, said second scoring means having a second scoring profile and a second scoring profile support means for operably supporting said second scoring profile;

said second scoring profile means including a second scoring bead which creates a second score line in said paper products, parallel to and distally spaced from said score line created by said scoring means, and said second integrated shoulder means transversely projecting from said other side of said second scoring bead, opposite said one side of said second scoring bead, for partially crushing a second portion of said paper products on said other side of said second score line to, in turn, weaken said second portion of said products;

said second scoring profile means being substantially devoid of integrated shoulder means on the one side of said second scoring bead, opposite said other side of said scoring bead, leaving substantially uncrushed the portion of said paper products on side one side of said second score line;

said one side and said other side being located such that said portion and said second portion are respectively separated by said score line and said second score line such that a section of said paper products remains substantially uncrushed between both of said score lines;

said orientation of said scoring means and said second scoring means thereby reducing the random yielding of said paper products at said score lines, to substantially reduce the skewing of paper product portions positioned about said score line and said second score line and controlling the extent of manufacturer's gap variation arising upon articulation of said paper products.

11. The invention according to claim 10 wherein the invention further comprises:

second paper products platform means for removably maintaining said paper products in an operable position between said second scoring means and said second paper products platform means to facilitate the imparting of said second score line in said paper products by said second scoring means.

12. A scoring apparatus of the type operably maintained by a supporting structure for use in imparting scores in paper products, such as liner board bonded corrugated medium, to reduce the occurrence of random yielding of said paper products upon folding of same, said scoring apparatus comprising:

scoring means for operably imparting scores in said paper products, said scoring means having a scoring profile and a scoring profile support means for operably supporting said scoring profile;

said scoring profile means including a scoring bead for imparting scores in said paper products to, in turn, create a score line along which said paper product can be folded in a facilitated manner, and integrated shoulder means transversely projecting from one side of said scoring bead for partially crushing a portion of said paper products on said one side of said score line to, in turn, weaken said portion of said paper products;

said scoring profile means being substantially devoid of a second integrated shoulder means on the other side of said scoring bead, opposite said one side of said scoring bead, leaving substantially uncrushed the portion of said paper products on said other side of said score line;

scoring means connection means for operably connecting said scoring profile support means to said supporting structure for operably supporting said scoring means;

paper products platform means for removably maintaining said paper products in an operable position between said scoring means and said paper products platform means to facilitate the imparting of said scores in said paper products by said scoring means;

power means operably associated with said scoring apparatus for forcing at least said scoring means and said paper products into contact with one another, respectively, to impart said score line into said paper products;

said scoring bead and said integrated shoulder on said one side of said scoring bead imparting said score line to said paper products while substantially weakening said portion of said paper products on said one side of said score line, while substantially maintaining the structural integrity of said paper products on said other side of said score line so as to reduce the random yielding of said paper products sheet, during the folding of said paper products along said score line;

second scoring means for operably imparting scores in said paper products, said second scoring means having a second scoring profile and a second scoring profile support means for operably supporting said second scoring profile;

said second scoring profile means including a second scoring bead which creates a second score line in said paper products, parallel to and distally spaced from said score line created by said scoring means, and said second integrated shoulder means transversely projecting from said other side of said second scoring bead, opposite said one side of said second scoring bead, for partially crushing a second portion of said paper products on said other side of said second score line to, in turn, weaken said second portion of said products;

said second scoring profile means being substantially devoid of integrated shoulder means on the one side of said second scoring bead, opposite said other side of said scoring bead, leaving substantially uncrushed the portion of said paper products on side one side of said second score line;

said one side and said other side being located such that said portion and said second portion are respectively separated by said score line and said second score line such that a section of said paper products remains substantially uncrushed between both of said score lines; and said orientation of said scoring means and said second scoring means thereby reducing the random yielding of said paper products at said score lines, to substantially reduce the skewing of paper product portions positioned about said score line and said second score line and controlling the extent of manufacturer's gap variation arising upon articulation of said paper products.

13. The invention according to claim 12 wherein the invention further comprises:

second paper products platform means for removably maintaining said paper products in an operable position between said second scoring means and said second paper products platform means to facilitate the imparting of said second score line in said paper products by said second scoring means.

* * * * *